US010158201B2

(12) United States Patent
Chen

(10) Patent No.: US 10,158,201 B2
(45) Date of Patent: Dec. 18, 2018

(54) COAXIAL CABLE CONNECTOR

(71) Applicant: Ming-Ching Chen, Taipei (TW)

(72) Inventor: Ming-Ching Chen, Taipei (TW)

(73) Assignee: Ming-Ching Chen, Taipei (TW)

( * ) Notice: Subject to any disclaimer, the term of this patent is extended or adjusted under 35 U.S.C. 154(b) by 0 days.

(21) Appl. No.: 15/644,845

(22) Filed: Jul. 10, 2017

(65) Prior Publication Data

US 2018/0013246 A1 Jan. 11, 2018

(30) Foreign Application Priority Data

Jul. 11, 2016 (TW) ..... 105210313 U

(51) Int. Cl.

| | |
|---|---|
| ***H01R 4/18*** | (2006.01) |
| ***H01R 4/20*** | (2006.01) |
| ***H01R 9/05*** | (2006.01) |
| ***H01R 13/52*** | (2006.01) |
| ***H01R 24/40*** | (2011.01) |
| ***H01R 103/00*** | (2006.01) |

(52) U.S. Cl.

CPC ..... *H01R 24/40* (2013.01); *H01R 4/183* (2013.01); *H01R 4/20* (2013.01); *H01R 9/0518* (2013.01); *H01R 13/5202* (2013.01); *H01R 2103/00* (2013.01)

(58) Field of Classification Search

CPC ..... H01R 9/0518; H01R 2103/00; H01R 9/05–9/053; H01R 24/40; H01R 4/183; H01R 4/20; H01R 13/5202

USPC ..... 439/578–585

See application file for complete search history.

(56) References Cited

U.S. PATENT DOCUMENTS

| | | | | |
|---|---|---|---|---|
| 5,651,699 A * | 7/1997 | Holliday | ..... | H01R 9/0518 439/582 |
| 5,667,405 A * | 9/1997 | Holliday | ..... | H01R 9/0518 439/271 |
| 5,975,949 A * | 11/1999 | Holliday | ..... | H01R 9/0518 439/585 |
| 6,783,394 B1 * | 8/2004 | Holliday | ..... | H01R 9/0518 439/578 |
| 2003/0051897 A1 * | 3/2003 | Blouin | ..... | H01B 11/1834 174/106 R |

(Continued)

*Primary Examiner* — Gary F Paumen

(74) *Attorney, Agent, or Firm* — Min-Lee Teng; Litron Patent & Trademark Office

(57) ABSTRACT

A coaxial cable connector comprising an inner sleeve, a nut and an outer sleeve, wherein the inner sleeve includes a first outer flange, a first rear extension portion, and a first surface being between the first outer flange and the first rear extension portion; the nut includes an inner threaded surface, and a first inner flange being between the first outer flange and the first surface; the outer sleeve includes a second rear extension portion and a second inner flange being on the first surface and an annular space formed between the first and second rear extension portions, wherein the outer sleeve further comprises a second outer flange disposed on the out surface of the outer sleeve outside the annular space, wherein the second outer flange has a maximum diameter greater than an outer diameter of the second inner flange, and an axial distance between a front end of the second outer flange and a rear end of the outer sleeve is greater than twice of that between the front end of the second outer flange and a front end of the annular space.

20 Claims, 11 Drawing Sheets

(56) References Cited

U.S. PATENT DOCUMENTS

| | | | | |
|---|---|---|---|---|
| 2004/0097130 | A1* | 5/2004 | Holliday | H01R 9/0518 439/585 |
| 2005/0048836 | A1* | 3/2005 | Holliday | H01R 9/0518 439/585 |
| 2009/0280668 | A1* | 11/2009 | Rodrigues | H01R 9/0524 439/271 |
| 2010/0273351 | A1* | 10/2010 | Holliday | H01R 9/0518 439/584 |
| 2012/0178289 | A1* | 7/2012 | Holliday | H01R 9/0518 439/585 |
| 2012/0244747 | A1* | 9/2012 | Chen | H01R 9/0518 439/578 |
| 2015/0270656 | A1* | 9/2015 | Youtsey | H01R 9/0527 439/585 |

* cited by examiner

COAXIAL CABLE CONNECTOR

This patent application claims priority of Taiwan Patent Application No. 105210313, filed on Jul. 11, 2016, the entirety of which is incorporated herein by reference.

BACKGROUND OF THE DISCLOSURE

Field of the Disclosure

The present invention relates to a connector, and more particularly to a coaxial cable connector for mounting to a coaxial cable.

Brief Description of the Related Art

The cable TV signal is connected to a television using a coaxial cable. This coaxial cable can be also connected to cable TV decoders (cable TV decoders), digital hard disk recorder such as video cassette recorder/digital video disc (VCR/DVD), satellite receivers, video games, TV signal distribution splitters or switches by way of a rotary connector such as a screw-on F-type connector.

SUMMARY OF THE DISCLOSURE

When a coaxial cable is mounted to a conventional coaxial cable connector, the coaxial cable is often prone to detach resulting from the outer sleeve of the conventional coaxial cable connector being not fixed or poorly engaged. Furthermore, when the coaxial cable is mounted to a conventional coaxial cable connector, it is not easy for a user to apply force due to the smoothness of the outer surface of the outer sleeve of the conventional coaxial, which makes it difficult to mount the coaxial cable to the coaxial cable connector.

In one embodiment, a coaxial cable connector for mounting a coaxial cable thereto is provided, the coaxial cable connector comprising an inner sleeve comprising a first outer flange, a first surface and a first rear extension, the first surface being between the first outer flange and the first rear extension; a nut, coaxially arranged with the inner sleeve and comprising a first inner flange and an inner threaded surface, the first inner flange being located between the first outer flange and the first surface; and an outer sleeve, coaxially arranged with the inner sleeve and comprising a second inner flange, a second outer flange and a second rear extension, the second outer flange being located between the second inner flange and the second rear extension, the second inner flange is disposed on the first surface, the first and second rear extensions have an annular space therebetween, the second outer flange is disposed on the outer surface of the outer sleeve and located outside of the annular space, wherein the second outer flange has a maximum outer diameter greater than an outer diameter of the second inner flange; and wherein when the coaxial cable is mounting to the coaxial cable connector, the second rear extension is deformed into a cone-like shape to shrink a gap of the annular space, and the deformed second rear extension presses the coaxial cable to fixedly engage therewith.

In one embodiment, a coaxial cable connector for mounting a coaxial cable thereto is provided, the coaxial cable connector comprising an inner sleeve, a nut and an outer sleeve, wherein the inner sleeve has a first outer flange, a first surface and a first rear extension, wherein the first surface is located between the first outer flange and the first rear extension; the nut is coaxially arranged with the inner sleeve and comprises a first inner flange and an inner threaded surface, the first inner flange being located between the first outer flange and the first surface; the outer sleeve is coaxially arranged with the inner sleeve and has a second inner flange and a second rear extension, wherein the second inner flange is disposed on the first surface, and the first rear extension and the second rear extension form an annular space therebetween, wherein the outer sleeve further comprises a second outer flange disposed on the outer surface of the outer sleeve and located outside of the annular space, wherein the second outer flange has a maximum outer diameter greater than an outer diameter of the second inner flange, and an axial distance between a front end of the second outer flange and a rear end of the outer sleeve is greater than twice of that between the front end of the second outer flange and a front end of the annular space.

In one embodiment, a coaxial cable connector for mounting a coaxial cable thereto is provided, the coaxial cable connector comprising an inner sleeve, a nut and an outer sleeve, wherein the inner sleeve comprises a first outer flange, a first surface and a first rear extension, wherein the first surface is located between the first outer flange and the first rear extension; the nut is coaxially arranged with the inner sleeve and has a first inner flange and an inner threaded surface, wherein the first inner flange is located between the first outer flange and the first surface; and the outer sleeve is coaxially arranged with the inner sleeve and comprises a second inner flange and a second rear extension, wherein the second inner flange is disposed on the first surface, and the first and second rear extensions form an annular space therebetween, wherein the outer sleeve further comprises a second outer flange disposed on the outer surface of the outer sleeve and located outside of the annular space, wherein the second outer flange has a maximum outer diameter greater than an outer diameter of the second inner flange, and an axial distance between a front end of the second outer flange and a rear end of the outer sleeve is greater than 1.5 times of that between the front end of the second outer flange and a front end of the annular space.

These, as well as other components, steps, features, benefits, and advantages in accordance with one embodiment of the present invention, will now become clear from a review of the following detailed description of illustrative embodiments, the accompanying drawings, and the claims.

Figure 1:
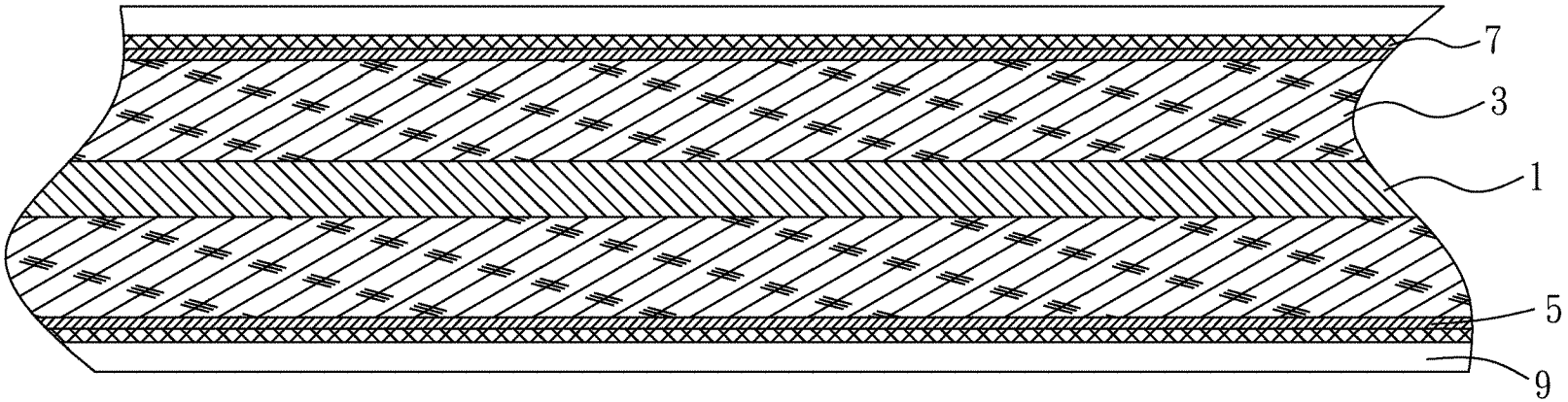
FIG. 1 is a cross-sectional view of a coaxial cable in accordance with one embodiment of the present invention.

While certain embodiments are depicted in the drawings, one skilled in the art will appreciate that the embodiments depicted are illustrative and that variations of those shown, as well as other embodiments described herein, can be envisioned and practiced within the scope in accordance with one embodiment of the present invention.

DETAILED DESCRIPTION OF THE INVENTION

The drawings disclose illustrative embodiments in accordance with one embodiment of the present invention. They do not set forth all embodiments. Other embodiments can be used in addition or instead. Details that can be apparent or unnecessary can be omitted to save space or for more effective illustration. Conversely, some embodiments can be practiced without all of the details that are disclosed. When the same reference number or reference indicator appears in different drawings, it can refer to the same or like components or steps.

Aspects of the disclosure can be more fully understood from the following description when read together with the accompanying drawings, which are to be regarded as illustrative in nature, and not as limiting. The drawings are not necessarily to scale, emphasis instead being placed on the principles of the disclosure. In the drawings:

Illustrative embodiments are now described. Other embodiments can be used in addition or instead. Details that can be apparent or unnecessary can be omitted to save space or for a more effective presentation. Conversely, some embodiments can be practiced without all of the details that are disclosed.

In one embodiment of the present invention, a coaxial cable connector is provided. A coaxial cable connector, as shown in FIG. 1 a cross-sectional view of coaxial cable connector, includes a metal wire 1, an insulating layer 3 enclosing the metal wire 1, a metal film 5 enclosing the insulating layer 3, a metal braided layer 7 enclosing the metal film 5, and a plastic jacket layer 9 enclosing the metal braided layer 7. The metal wire 1 can be made of copper, iron, silver, nickel, tin, gold, a copper-gold alloy, a copper-tin alloy, a copper-nickel alloy, or other suitable metal material. The material of metal film 5 can include aluminum, copper or other suitable metal, and the metal film 5 can be in the form of aluminum foil or copper foil as well, wherein the metal film 5 has an electrical shielding effect to reduce electrical interference. The metal braided layer 7 can be in the form of two, three or four layers of metal braided, and the metal braided layer 7 can be made of aluminum, aluminum alloy, copper, copper alloy or other suitable metal material.

Please refer to FIGS. 2*a*-2*d*, which illustrates in a sequence the 3D view, the 3D exploded view, the exploded cross-sectional view and the cross-sectional view of the coaxial cable connector. The coaxial cable connector can include an inner sleeve 10, outer sleeve 12, a rubber ring 16 and a nut 14. Each of the inner sleeve 10, outer sleeve 12 and nut 14 can be made of a conductive material, such as copper, iron, silver, nickel, tin, gold, a copper-gold alloy, a copper-tin alloy, other polymers with favorable conductivity or a non-metal conductor. The inner sleeve 10, the outer sleeve 12 and the nut 14 can be electroplated by an electro electroplating or electroless-plating process or it can be covered with a rust-proof metal layer, and the inner sleeve 10, the outer sleeve 12 and the nut 14 can be made of metal material such as copper, iron, silver, nickel, tin, gold, a copper-gold alloy, a copper-tin alloy or other suitable metal. Additionally, the rubber ring 16 can be made of rubber material, or other flexible and waterproof polymer material.

The inner sleeve of the coaxial cable connector has a perforation 102 along the axial direction of the coaxial cable connector, a first outer flange 104, a second outer flange 106, a first surface 108 and a first rear extension 110, wherein the cross sectional of the perforation 102 has an annular shape, and the perforation 102 is disposed between the first outer flange 104 and the second outer flange 106, wherein the rubber ring 16 surrounds the annular shape of the perforation 102, and the second outer flange 106 is located between the first surface 108 and the first outer flange 104, with the first surface 108 located between the first rear extension 110 and the second outer flange 106.

The nut 14 of the coaxial cable connector has a perforation 142 along the axial direction of the coaxial cable connector, a first inner flange 144 and an inner threaded surface 146, wherein the nut 14 can be in a hexagonal nut, square, annular nut, wing or any other suitable shape such that it can be locked to an electronic device by using a wrench or other tools. The diameter of the perforation 142 of the nut 14 is respectively greater than that of the second outer flange 106 and the first rear extension 110 of the inner sleeve 10 but less than the diameter of the first outer flange 104. The first rear extension 110 of the inner sleeve 10 can pass through the perforation 142 of the nut 14 so as to dispose the first inner flange 144 of the nut 14 on the second outer flange 106. Furthermore, the nut 14 can rotate on the second outer flange 106, wherein when the first inner flange 144 of the nut 14 is moved toward the first outer flange 104, the first inner flange 144 of the nut 14 can press the rubber ring 16 in the groove 112 to deform the rubber ring 16 with a side surface of the first outer flange 104 abutting against the first inner flange 144 of the nut 14, so that the deformed rubber ring 16 can fill the gaps between the first inner flange 144, the second outer flange 106 and the first outer flange 104 of the nut 14 for achieving the waterproof effect.

The outer sleeve 12 of the coaxial cable connector has a perforation 122 along the axial direction of the coaxial cable connector, a second inner flange 124, a third outer flange 126, a second rear extension, a second surface 130 and a third surface 132. The third outer flange 126 surrounds the outer surface of the outer sleeve 12 between the second surface 130 and the second rear extension 128, wherein the diameter of the perforation 122 is greater than that of the first rear extension 110 of the inner sleeve 10 but less than that of the second outer flange 106. Additionally, the third surface 132 is an outer surface of the second inner flange 124, and the maximum diameter of the top surface of the third outer flange 126 is greater than the diameter of the third surface 132. The first rear extension 110 of the inner sleeve 10 can pass through the perforation 122 of the outer sleeve 12 so as to dispose the second inner flange 124 of the outer sleeve 12 on the first surface 108. The second inner flange 124 is engaged with the first surface 108 in a tightly-fitting manner. At this time, the second rear extension 128 and the first rear extension 110 form an annular space therebetween, wherein the third outer flange 126 (including the front and rear ends of the third outer flange 126) is located outside the annular space. Additionally, a front end of the third outer flange 126 is located radially outside the annular space. The axial distance between the front end of the third outer flange 126 and the rear end of the outer sleeve 12 is greater than twice of that between the front end of the third outer flange 126 and the front end of the annular space; or the axial distance from the third outer flange 126 to the rear end of the outer sleeve 12 is greater than 1.5 times of that between the rear end of the third outer flange 126 and the front end of the annular space. Also, the first inner flange 144 of the nut 14 is axially movable between the second inner flange 124 of the outer sleeve 12 and the first outer flange 104 of the inner sleeve 10 and is freely rotatable on the second outer flange 106 when assembly is completed.

Figure 2A:
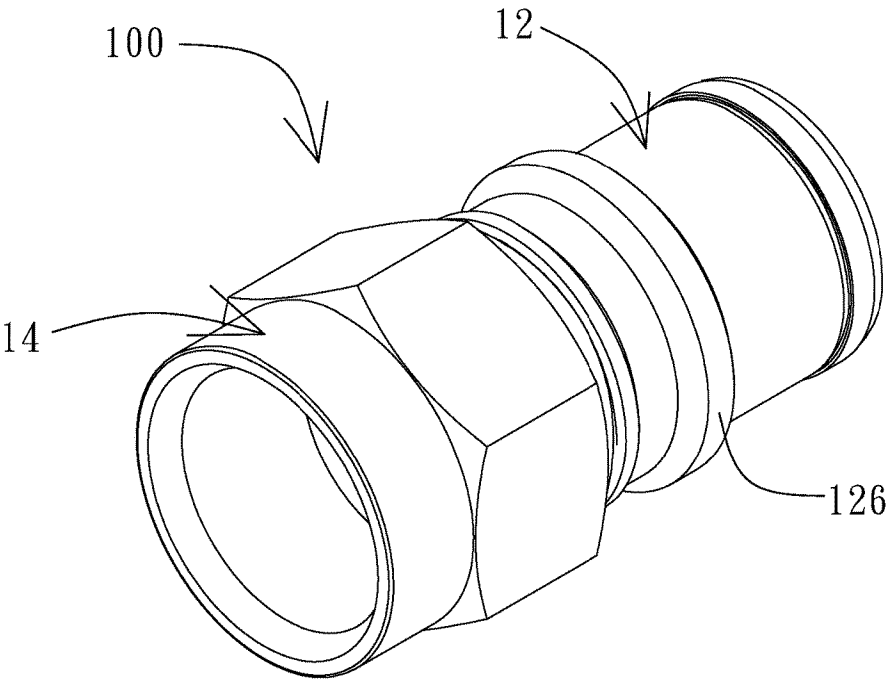
FIG. 2*a* is a 3D view of the coaxial cable connector.
Figure 2B:
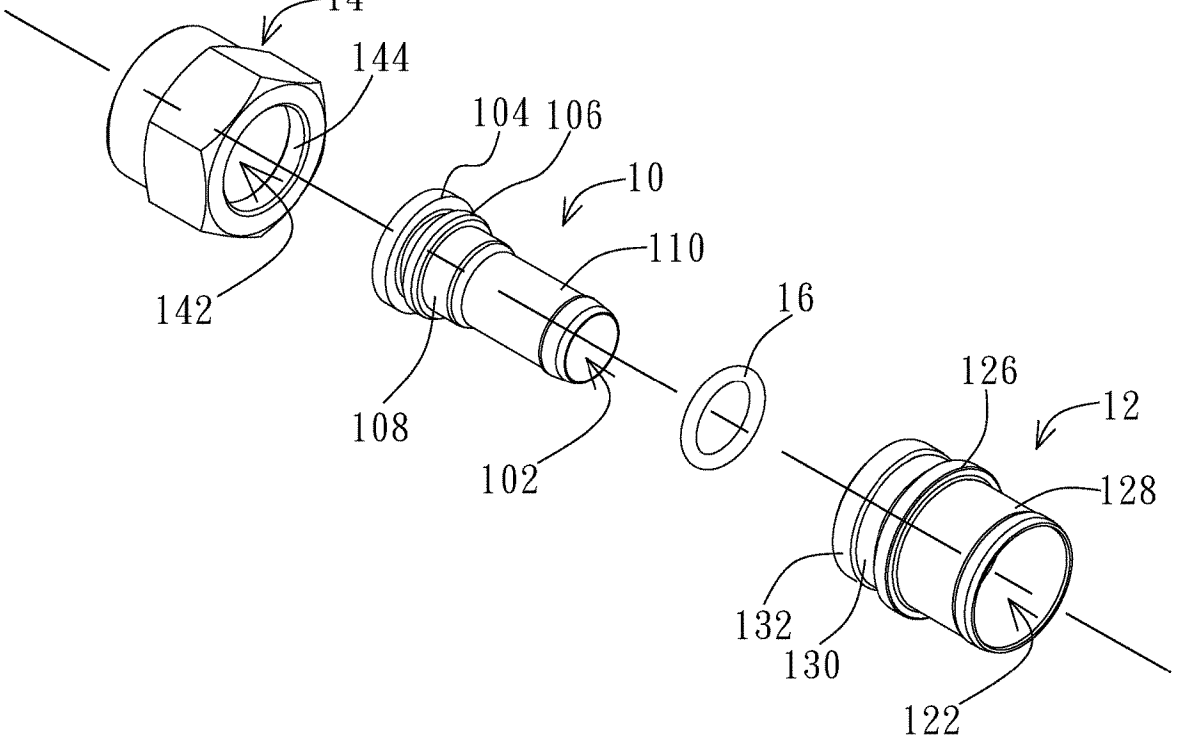
FIG. 2*b* is a 3D exploded view of the coaxial cable connector.
Figure 2C:
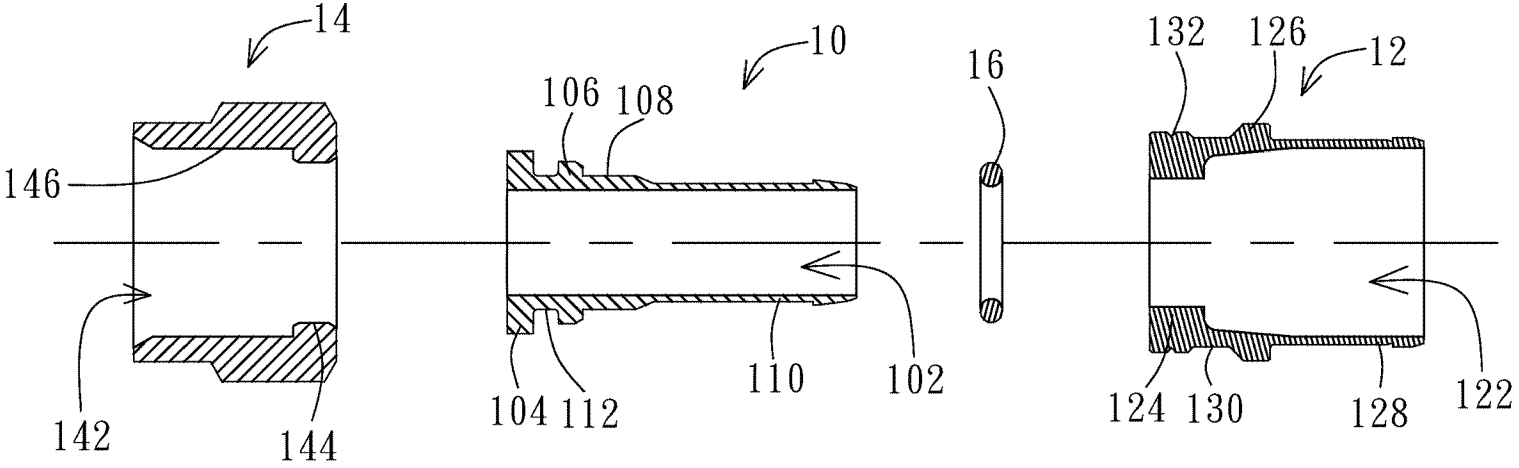
FIG. 2*c* is an exploded cross-sectional view of the coaxial cable connector.
Figure 2D:
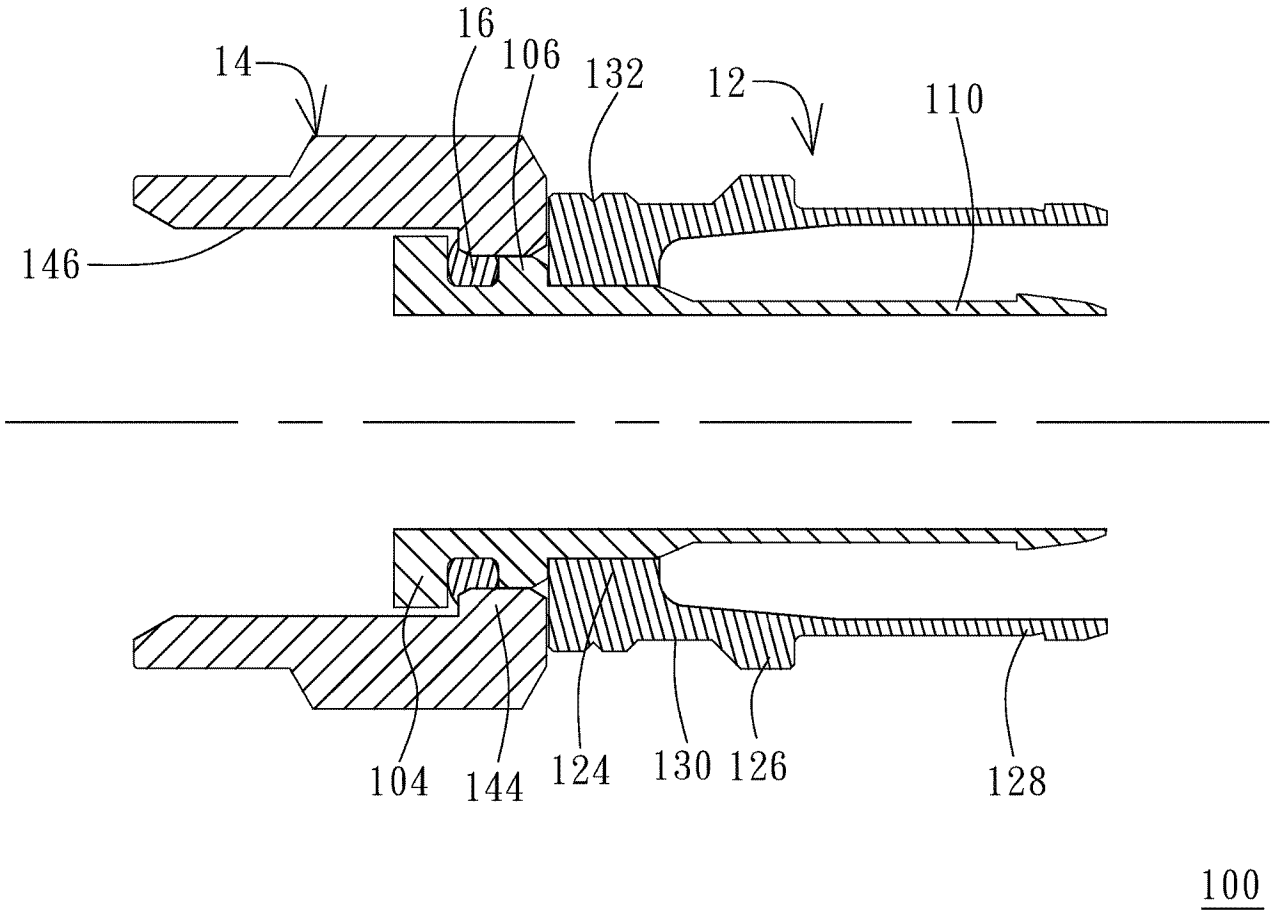
FIG. 2*d* is a cross-sectional of the coaxial cable connector.
Figure 2E:
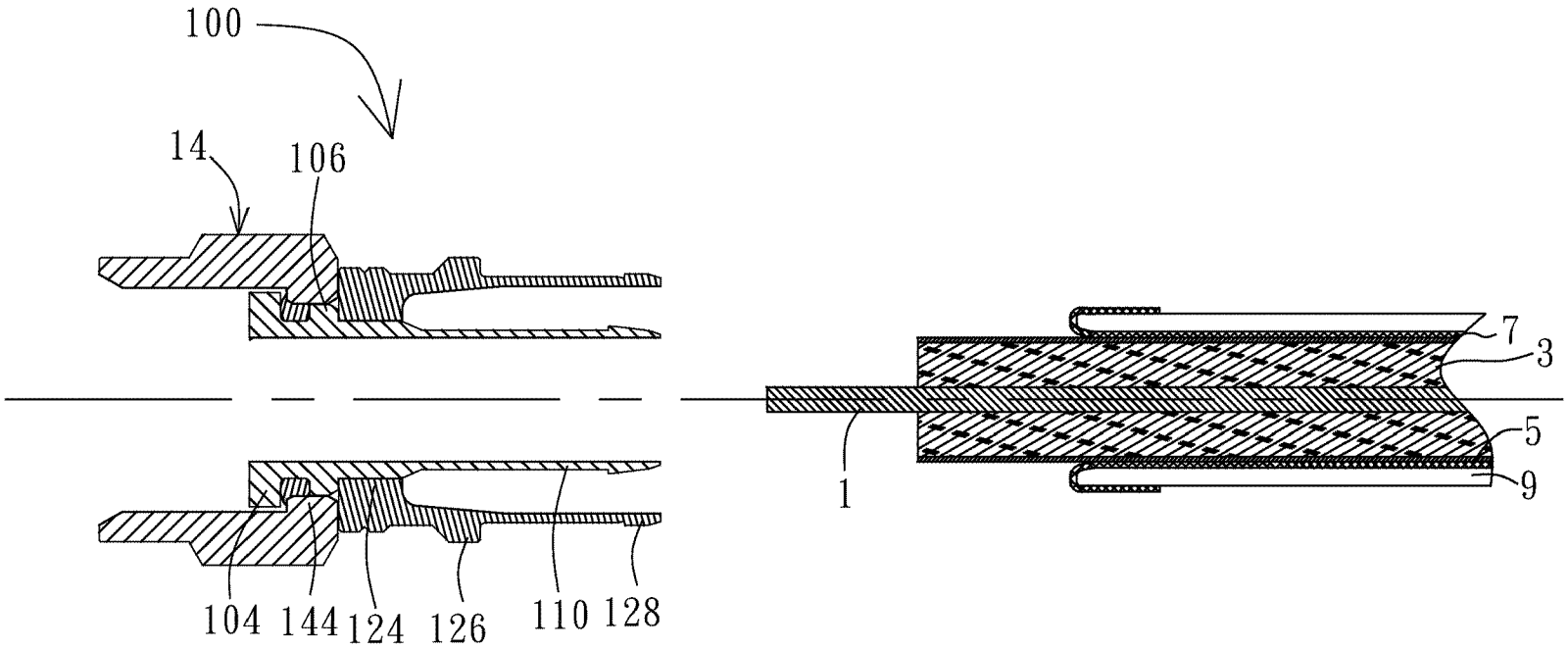
FIGS. 2*e*-2*f* are schematics of the coaxial cable connector connected to a coaxial cable.
Figure 2F:
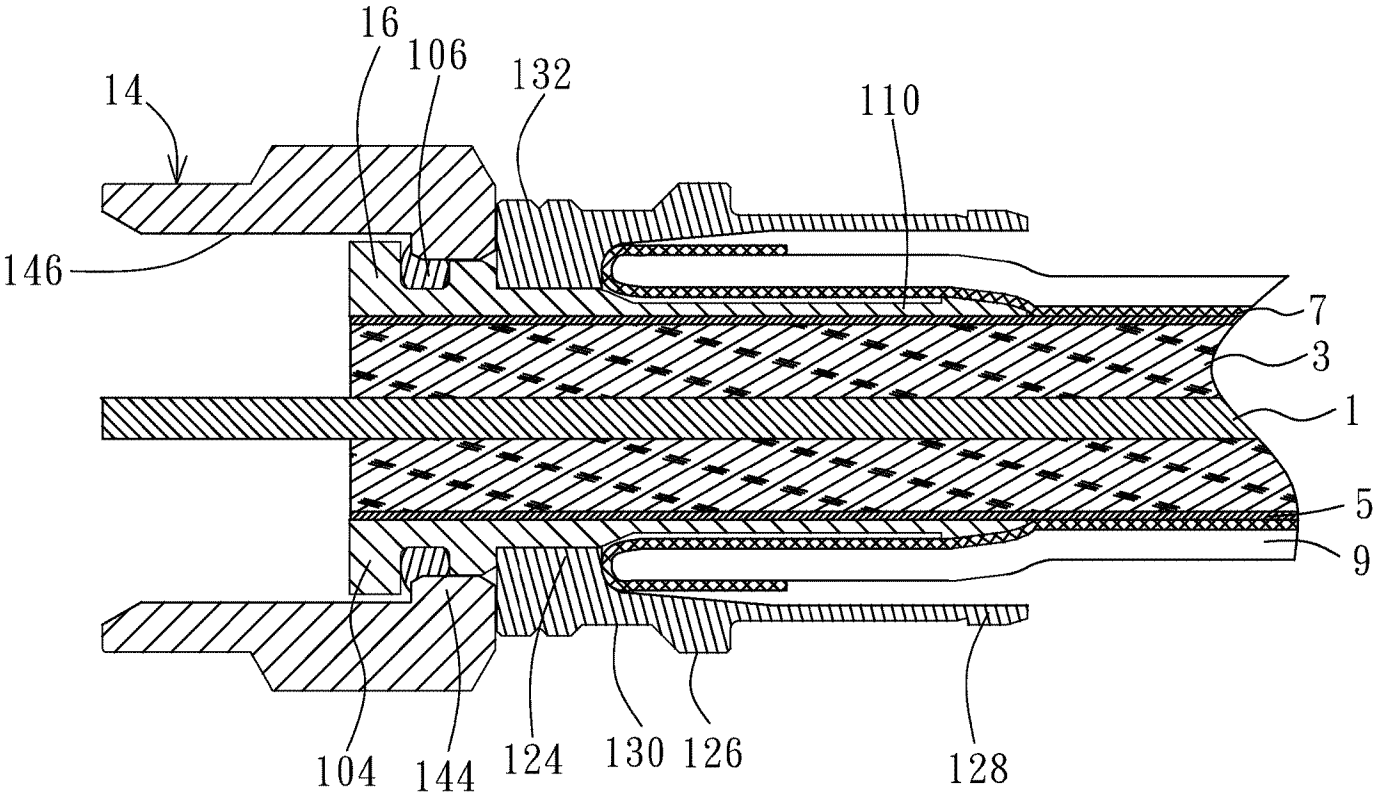
Figure 2G:
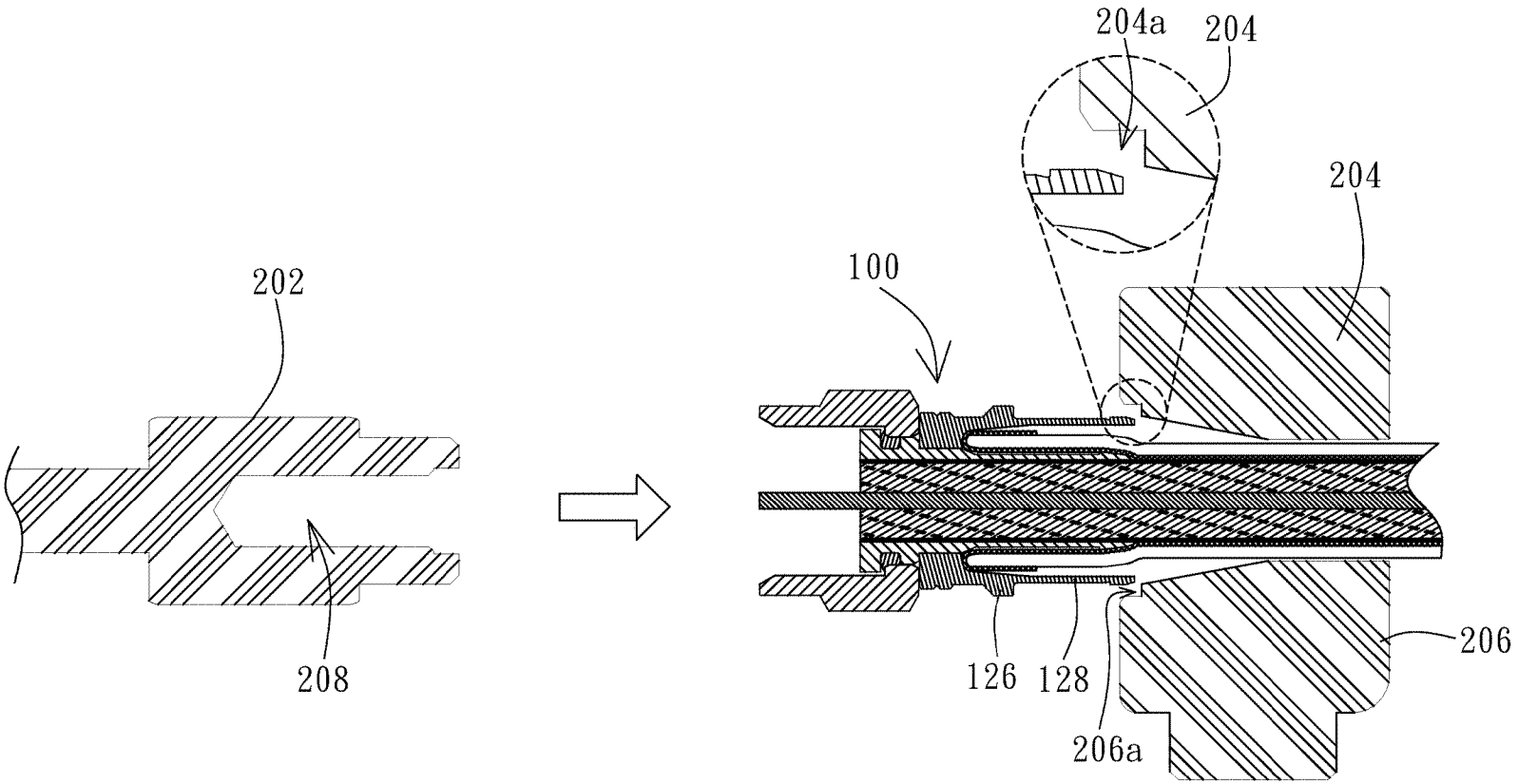
FIGS. 2*g*-2*i* are schematics of the coaxial cable connector deformed via mold compression.
Figure 2H:
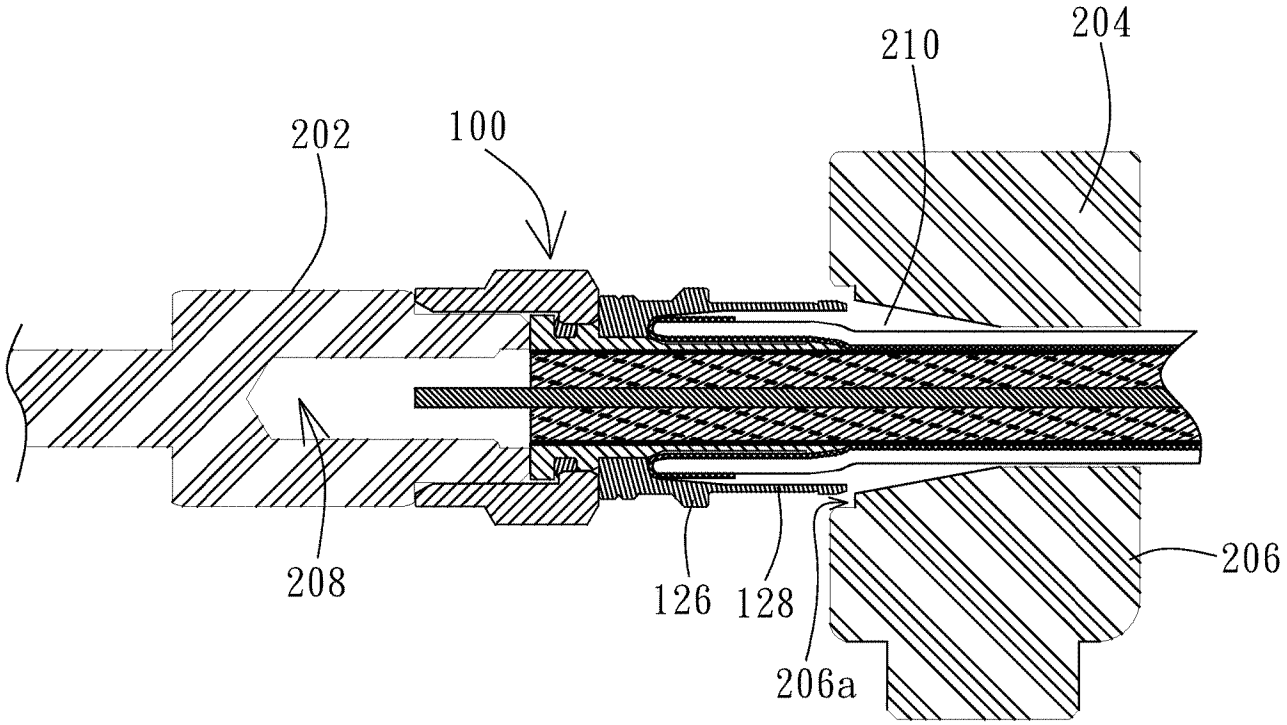
Figure 2I:
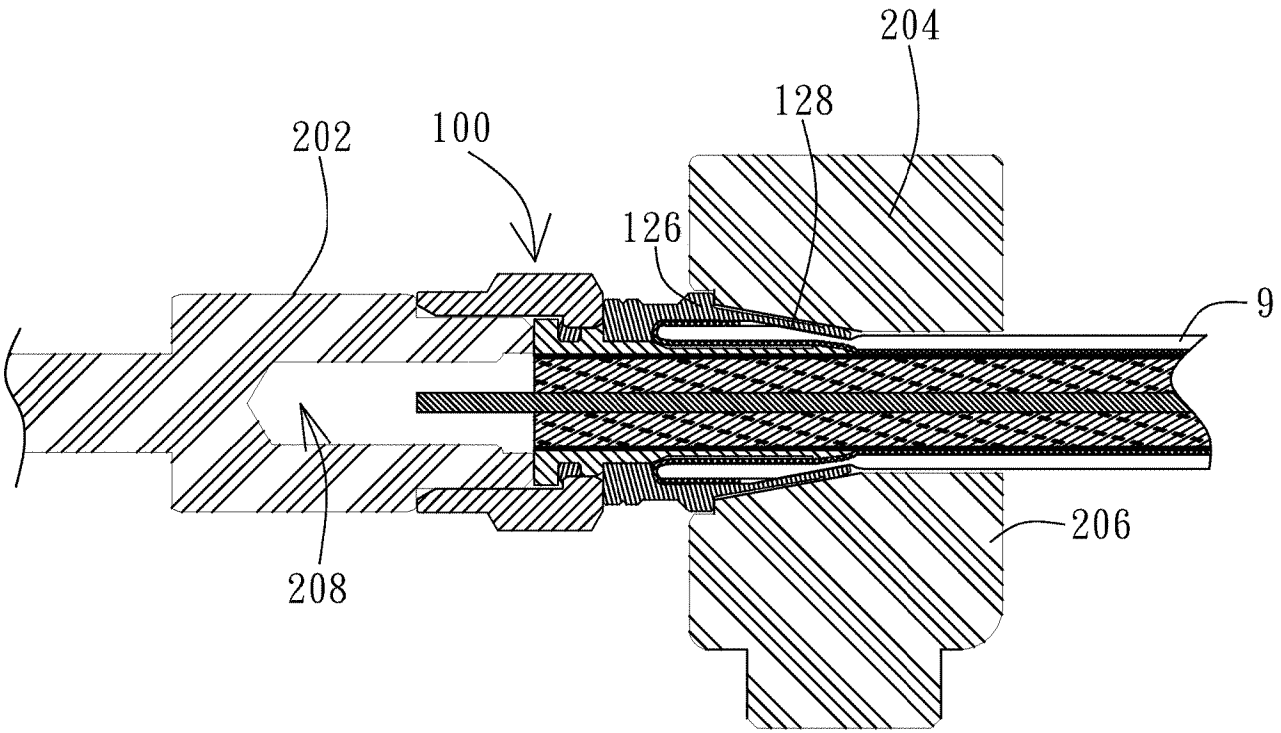

As shown in FIGS. 2*e*-2*f*, when the coaxial cable is mounted to the coaxial cable connector 100, a portion of the plastic jacket layer 9 is removed, and then the metal braided layer 7 will be turned inside out to cover the outer surface of the plastic jacket layer 9. The metal braided layer 7 and the plastic jacket layer 9 of the coaxial cable are squeezed into the gap 387 between the first rear extension 110 of the inner sleeve 10 and the second rear extension 128 of the outer sleeve 12. The metal wire 1, the insulating layer 3 and the metal film layer 5 of the coaxial cable are inserted into the front end of the perforation 102 of the inner sleeve 20 from the rear end of the perforation 102, wherein the metal wire 1 extends into the space formed by the inner threaded surface 146 of the nut 14.

As shown in FIGS. 2*g*-2*j*, the coaxial cable connector 100 for mounting a coaxial cable thereto is placed on a mold device. The mold device includes a plunger 202, a first mold 204 and a second mold 206, wherein the plunger 202 includes a recess 208 used for accommodating the metal wire 1 and located within the inner threaded surface 146 of the nut 14, and wherein the first mold 204 and the second mold 206 can be either combined or separated from each other. The combined first mold 204 and the second mold 206 have a cone-like perforation 210 therebetween, and the inner surface of the first mold 204 has a first stepping part 204*a*, and the inner surface of the first mold 204 has a second stepping part 206*a*. The positions of the first stepping part 204*a* and the second stepping part 206*a* correspond to each other and are located along a same radial direction. When the first mold 204 combines with the second mold 206, an arc surface of the inner surface of the first mold 204 is adapted to face an arc surface of the inner side surface of the second mold 206 so as to form a cone-like perforation 210. The cone-like perforation 210 can be used to insert the coaxial cable into the coaxial cable connector 100.

The plunger 202 is pushed so that the recess 208 of the plunger 202 can accommodate the metal wire 1 located in the inner threaded surface 146 and abut against the nut 14 and the first outer flange 104 of the inner sleeve 10. The plunger 202 then pushes the coaxial cable connector 100 to the cone-like perforation 210 formed by the combined first and second molds 204 and 206, at this time, the second rear extension 128 of the outer sleeve 12 will abut against the inner wall of the cone-like perforation 210, wherein during a period a push force is applied to the coaxial cable connector 100 by a user, the second rear extension 128 of the outer sleeve 12 is radially pressed and deformed into a cone-like shape; that is, the diameter d1 of the second rear extension 128 adjacent to the outer sleeve 12 is reduced to a diameter d2, wherein the diameter d1 of the second surface 130 remains unchanged and the gap between the second rear extension 128 and the first rear extension 110 becomes smaller so as to press the metal braided layer 7 and the plastic jacket layer 9, so that the coaxial cable and the coaxial cable connector 100 can be tightly engaged with each other to avoid peeling off. Then, when the third outer flange 126 of the outer sleeve 12 abuts against the first stepping part 204*a* and the second stepping part 206*a*, the coaxial cable connector 100 will no longer move, indicating deformation of the second rear extension 128 of the outer sleeve 12 has been carried out. The first mold 204 and the second mold 206 are then separated from each other to remove the coaxial cable connector 100 with the coaxial cable.

Figure 2J:
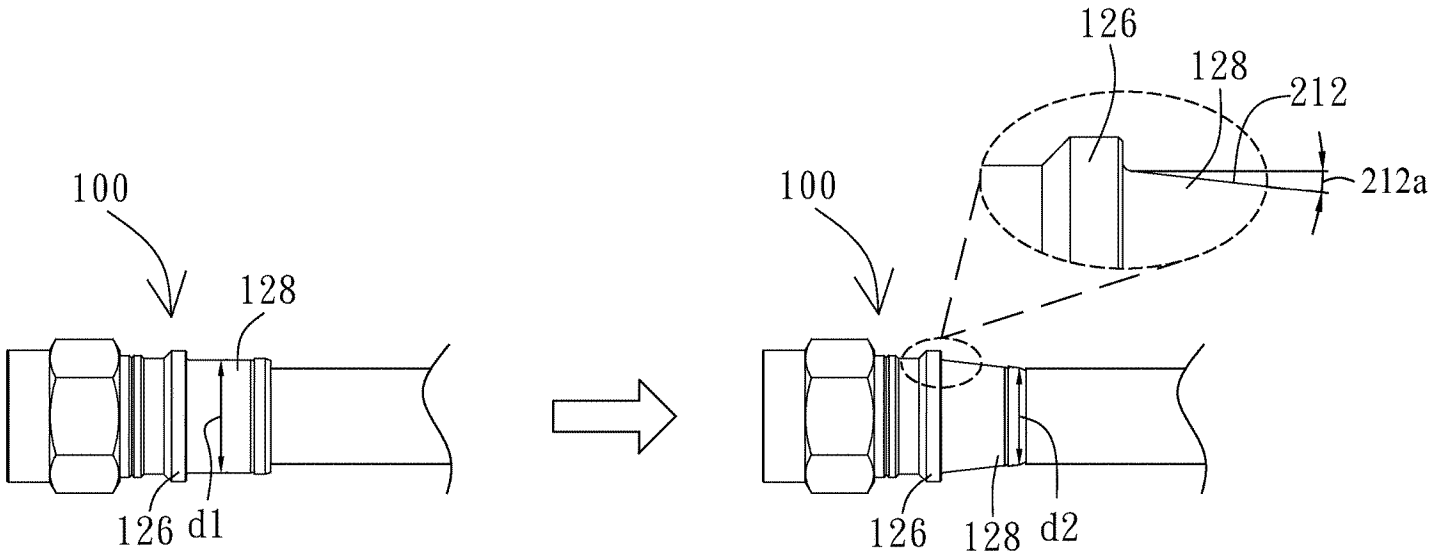
FIG. 2*j* is a schematics of an external view of the deformed coaxial cable connector.

As shown in FIG. 2*j*, the second rear extension 128 of the outer sleeve 12 has a cone-like surface 212 after deformation. The cone-like surface 212 intersects an axis of the coaxial cable connectors 100 to form an angle 212*a*, said angle 212*a* being between 5 and 20 degrees, between 10 and 30 degrees, or between 7 degrees and 35 degrees.

The third outer flange 126 on the outer sleeve 12 provides a timely blockage when the mold is deformed by pressing so that the coaxial cable connector 100 is easily removed from the mold assembly and the outer sleeve 12. The third outer flange 126 allows the user to grip it easily, making it easier to mount the coaxial cable to the coaxial cable connector 100.

Though the embodiment of the present invention have been shown and described, it will be understood by those skilled in the art that such embodiments can be varied without departing from the principles and spirit of the present invention.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

What is claimed is:

1. A coaxial cable connector for having a coaxial cable to be assembled therewith, comprising:

an inner sleeve;

a nut coaxially arranged with the inner sleeve, wherein the nut has an inner flange axially engaged with an outer flange of the inner sleeve; and an outer sleeve coaxially arranged with the inner sleeve, wherein the outer sleeve comprises an inner flange radially engaged with the inner sleeve, wherein the inner flange of the nut is engaged between the outer flange of the inner sleeve and the outer sleeve, wherein an annular space between the inner and outer sleeves axially extends from the inner flange of the outer sleeve to an open end thereof, wherein the outer sleeve has a portion around the annular space, wherein the portion of the outer sleeve slopes from an outer flange of the outer sleeve to the open end of the annular space, wherein the outer flange of the outer sleeve is radially around the annular space, wherein the outer flange of the outer sleeve has a front surface slopping outwardly from a front annular surface of the outer sleeve and a rear surface slopping outwardly from the portion of the outer sleeve, wherein the front and rear surfaces are radially around the annular space, wherein the portion of the outer sleeve has a first outer diameter at the open end of the annular space smaller than a second outer diameter of the portion of the outer sleeve at the outer flange of the outer sleeve, wherein the portion of the outer sleeve has an outer surface exposed to the outside after the coaxial cable connector is assembled with the coaxial cable.

2. The coaxial cable connector of claim 1, wherein the outer sleeve comprises a conductive material.

3. The coaxial cable connector of claim 1, wherein the outer surface of the portion extends from the outer flange of the outer sleeve to a rear end of the outer sleeve.

4. The coaxial cable connector of claim 1, wherein the inner flange of the outer sleeve is axially offset from the outer flange of the outer sleeve.

5. The coaxial cable connector of claim 1, wherein an angle between the outer surface of the portion and an axial direction is between 7 and 35 degrees.

6. The coaxial cable connector of claim 1, wherein the inner flange of the outer sleeve is radially engaged with the inner sleeve in a tightly-fitting manner.

7. A coaxial cable connector for having a coaxial cable to be assembled therewith, comprising:

an inner sleeve;

a nut coaxially arranged with the inner sleeve, wherein the nut has an inner flange axially engaged with an outer flange of the inner sleeve; and an outer sleeve coaxially arranged with the inner sleeve, wherein the outer sleeve comprises an inner flange radially engaged with the inner sleeve, wherein the inner flange of the nut is engaged between the outer flange of the inner sleeve and the outer sleeve, wherein an annular space between the inner and outer sleeves axially extends from the inner flange of the outer sleeve to an open end thereof, wherein the outer sleeve has a portion around the annular space, wherein the portion of the outer sleeve is configured to be deformed to slope from an outer flange of the outer sleeve to the open end of the annular space, wherein the outer flange of the outer sleeve is radially around the annular space, wherein the outer flange of the outer sleeve has a front surface slopping outwardly from a front annular surface of the outer sleeve and a rear surface slopping outwardly from the portion of the outer sleeve, wherein the front and rear surfaces are radially around the annular space, wherein the portion of the outer sleeve is configured to be deformed with a first outer diameter at the open end of the annular space and a second outer diameter at the outer flange of the outer sleeve, wherein the first outer diameter is smaller than the second outer diameter, wherein the portion of the outer sleeve has an outer surface exposed to the outside.

8. The coaxial cable connector of claim 7, wherein the inner sleeve comprises a conductive material.

9. The coaxial cable connector of claim 7, wherein the outer surface of the portion of the outer sleeve extends from the outer flange of the outer sleeve to a rear end of the outer sleeve.

10. The coaxial cable connector of claim 7, wherein the inner flange of the outer sleeve is axially offset from the outer flange of the outer sleeve.

11. The coaxial cable connector of claim 7, wherein the inner flange of the outer sleeve is radially engaged with the inner sleeve in a tightly-fitting manner.

12. The coaxial cable connector of claim 7, wherein the portion of the outer sleeve is configured to be deformed with an angle between the outer surface of the portion of the outer sleeve and an axial direction is between 7 and 35 degrees.

13. The coaxial cable connector of claim 7, wherein the outer sleeve comprises a conductive material.

14. A coaxial cable connector for having a coaxial cable to be assembled therewith, comprising:

an inner sleeve;

a nut coaxially arranged with the inner sleeve, wherein the nut has an inner flange axially engaged with an outer flange of the inner sleeve; and an outer sleeve coaxially arranged with the inner sleeve, wherein the outer sleeve comprises an inner flange radially engaged with the inner sleeve, wherein the inner flange of the nut is engaged between the outer flange of the inner sleeve and the outer sleeve, wherein an annular space between the inner and outer sleeves axially extends from the inner flange of the outer sleeve to an open end thereof, wherein the outer sleeve has a portion around the annular space, wherein the portion of the outer sleeve is configured to be deformed by a tool axially moving along the portion to an outer flange of the outer sleeve, wherein the outer flange of the outer sleeve is radially around the annular space, wherein the outer flange of the outer sleeve has a front surface slopping outwardly from a front annular surface of the outer sleeve and a rear surface slopping outwardly from the portion of the outer sleeve, wherein the front and rear surfaces are radially around the annular space, wherein the portion of the outer sleeve is configured to be deformed with a first outer diameter at the open end of the annular space and a second outer diameter at the outer flange of the outer sleeve, wherein the first outer diameter is smaller than the second outer diameter, wherein the portion of the outer sleeve has an outer surface exposed to the outside.

15. The coaxial cable connector of claim 14, wherein the inner sleeve comprises a conductive material.

16. The coaxial cable connector of claim 14, wherein the outer surface of the portion of the outer sleeve extends from the outer flange of the outer sleeve to a rear end of the outer sleeve.

17. The coaxial cable connector of claim 14, wherein the inner flange of the outer sleeve is axially offset from the outer flange of the outer sleeve.

18. The coaxial cable connector of claim 14, wherein the inner flange of the outer sleeve is radially engaged with the inner sleeve in a tightly-fitting manner.

19. The coaxial cable connector of claim 14, wherein the portion of the outer sleeve is configured to be deformed with an angle between the outer surface of the portion of the outer sleeve and an axial direction is between 7 and 35 degrees.

20. The coaxial cable connector of claim 14, wherein the outer sleeve comprises a conductive material.

* * * * *